US006322086B1

(12) United States Patent
Yokomachi et al.

(10) Patent No.: US 6,322,086 B1
(45) Date of Patent: Nov. 27, 2001

(54) SEAL STRUCTURE OF COMPRESSOR, AND THE COMPRESSOR

(75) Inventors: Naoya Yokomachi; Toshiro Fujii; Takayuki Imai; Tatsuya Koide, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/451,066

(22) Filed: Nov. 30, 1999

(30) Foreign Application Priority Data

Dec. 3, 1998 (JP) ..... 10-344204

(51) Int. Cl.[7] ..... F16J 15/02; F04B 1/12

(52) U.S. Cl. ..... 277/608; 277/627; 277/650; 277/910; 277/935

(58) Field of Search ..... 277/608, 609, 277/627, 650, 910, 935; 417/222.1, 269

(56) References Cited

U.S. PATENT DOCUMENTS 3,425,716 * 2/1969 Blau .
4,441,725 * 4/1984 Bailey .
4,789,373 * 12/1988 Adman .
5,244,355 * 9/1993 Fujii et al. ..... 417/269
5,941,530 * 8/1999 Williams .
6,227,814 * 5/2001 Yokomachi et al. ..... 417/269

FOREIGN PATENT DOCUMENTS 196 10 060 A 9/1996 (DE) .
A8-261150 10/1996 (JP) .
09 042156 2/1997 (JP) .
A9-42156 2/1997 (JP) .

OTHER PUBLICATIONS

EP 99 12 3736 Search Report dated Oct. 30, 2000.

* cited by examiner

*Primary Examiner*—Anthony Knight
*Assistant Examiner*—Enoch Peavey
(74) *Attorney, Agent, or Firm*—Woodcock Washburn LLP

(57) ABSTRACT

In a seal structure of a compressor according to the present invention, two O-rings 6 and 7 are disposed at a joint portion between a front housing 2 and a cylinder block 3 constituting a housing of a compressor 1. The inner O-ring 6 uses a material excellent in mechanical and chemical properties (nitrile rubber), and the outer O-ring 7 uses a material excellent in gas permeation resistance (butyl rubber). The inner O-ring 6 has a greater diameter and the outer O-ring 7 has a smaller diameter.

11 Claims, 3 Drawing Sheets

SEAL STRUCTURE OF COMPRESSOR, AND THE COMPRESSOR

BACKGROUND OF THE INVENTION

1. Field of the Invention

This invention relates to a seal structure of a compressor for use in an air conditioner and so forth.

2. Description of the Related Art

In compressors in general, constituent members that constitute a main housing are joined to one another and are fixed under this state by a plurality of bolts. An O-ring or a gasket seal is interposed into each joint portion in order to prevent pressure reduction.

Japanese Unexamined Patent Publication (Kokai) No. 8-261150 or 9-42156 discloses a seal structure for forming a multiple structure of O-rings or gasket seals. In the latter reference, two O-rings as seal members are interposed into the joint portions between members constituting a main housing. Because two O-rings are interposed, the sealing performance inside the housing can be improved.

However, the seal structure of the prior art is not free from the problem that when a high pressure gas such as carbon dioxide is used as a refrigerant, the carbon dioxide gas is likely to leak from the joint portion through a rubber material even when the O-ring made of the rubber material is constituted into the multiple structure, because carbon dioxide gas can easily permeate through the rubber material.

This problem may be solved by using a rubber material that has heat-resistance, oil resistance, blister resistance and gas permeation resistance in good balance, for the O-ring. However, it is practically difficult to select a material having all these functions, and even if the O-ring has a single-layered structure, the material cost becomes high.

In a multiple stage structure using the conventional rubber material, O-rings having the same diameter are stacked in multiple stages. When the diameter of the O-rings is increased in order to secure sufficient seal performance, the thickness of the housing must be increased at the seal portion, increasing the size of the housing. Even if the diameter of the O-ring is increased, the problem of the gas leak remains unsolved when the refrigerant is carbon dioxide.

SUMMARY OF THE INVENTION

In view of the problems described above, it is an object of the present invention to provide a seal structure of a compressor which structure can secure high sealing performance at joint portions and moreover, has a simple construction, by using seal members made of rubber, even when a refrigerant having relatively high permeability to the rubber materials is used in a compressor.

According to one aspect of the present invention for accomplishing the object described above, a seal structure of a compressor includes seal members made of a rubber and interposed into joint portions between constituent members of a main housing and into joint portions between fitting members fitted into a bore for inserting a rotary shaft and the housing, wherein a plurality of seal members are provided to at least one of the joint portions, a seal member excellent in both mechanical and chemical properties is disposed inside and a seal member excellent in gas permeation resistance is disposed outside, among a plurality of the seal members.

According to another aspect of the present invention, a steal structure of a compressor includes seal members made of a rubber and interposed into joint portions between constituent members of a main housing and into joint portions between fitting members fitted into a bore for inserting a rotary shaft and the housing, wherein a plurality of seal members having mutually different diameters are provided to at least one of the joint portions, a seal member or members having a greater diameter are disposed inside and a seal member or members having a smaller diameter are disposed outside.

According to another aspect of the present invention, the seal member having a greater diameter described above uses a material excellent in both mechanical and chemical properties, and the seal member having a smaller diameter uses a material excellent in gas permeation resistance.

According to still another aspect of the present invention, the constituent members described above comprise a cylinder main body, a front housing and a rear housing, and a plurality of the seal members are provided into the joint portions between the cylinder main body and both housings.

According to still another aspect of the present invention, the seal member is provided into the joint portion between the fitting member and an inner peripheral surface of the housing.

According to still another aspect of the present invention, the refrigerant used for the compressor is carbon dioxide.

According to these embodiments of the present invention, the inner seal member uses a material excellent in mechanical and chemical properties whereas the outer seal member uses a material excellent in gas permeation resistance, and the seal members having mutually different excellent functions can be provided to the joint portions. Consequently, even when the refrigerant gas permeates through the inner seal member, gas leakage is suppressed by the outer seal member, and high seal performance can be secured.

According to still another embodiment of the present invention, the refrigerant is sealed by the seal members in multiple stages, and the seal member having a greater diameter and disposed inside executes a main sealing function. Even when a part of the refrigerant permeates through the inner seal member, it is sealed by the seal member having a smaller diameter and disposed outside. In addition, because the permeation passage of the refrigerant gas passing through this seal member is thinly reduced, seal performance can be improved. Since the outer seal member has a small diameter, the thickness of the joint portion necessary for securing the arrangement space can be reduced to a relatively small thickness.

According to still another embodiment of the present invention, the seal member having a greater diameter, made of a material excellent in mechanical and chemical properties and disposed on the inner side of the joint portion mainly seals the refrigerant. The seal member having a smaller diameter, made of a material excellent in gas permeation resistance and disposed outside, seals the refrigerant gas that leaks from the inner seal member having a greater diameter.

According to still another embodiment of the present invention, high seal performance can be secured at the joint portions between the cylinder main body and both housings even when a refrigerant having relatively high gas permeability to the rubber materials is used.

According to still another embodiment of the present invention, high seal performance can be secured at the joint portions between fitting members fitted to a bore for inserting a rotary shaft and the housing even when a refrigerant having relatively high gas permeability to the rubber materials is used.

According to still another embodiment of the present invention, high seal performance can be secured at the joint portions even when the refrigerant is carbon dioxide.

The present invention may be more fully understood from the description of a preferred embodiment set forth below, together with the accompanying drawings.

DESCRIPTION OF THE PREFERRED EMBODIMENTS

Hereinafter, an embodiment of the present invention, that is applied to a seal structure of a compressor for use in an air conditioner, or the like, will be explained with reference to FIGS. 1 to 3.

Figure 1:
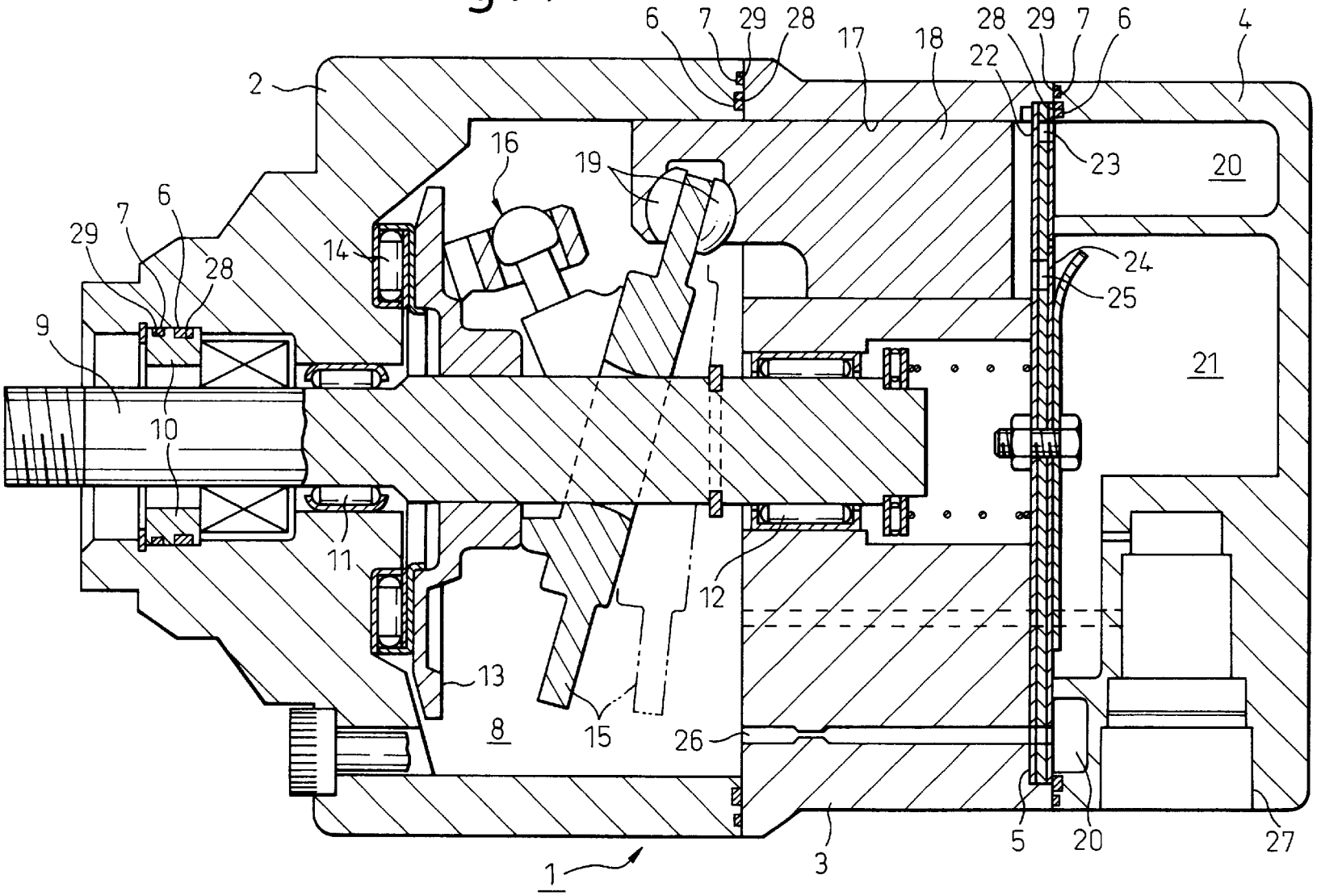
FIG. 1 is a sectional side view of a compressor in one embodiment of the present invention.

As shown in FIG. 1, the compressor 1 in this embodiment is of a variable capacity type, and uses carbon dioxide as a refrigerant. A front housing 2 is jointed and fixed to the front edge of a cylinder block 3. A rear housing 4 is jointed and fixed to the rear surface of the cylinder block 3 through a valve-port forming member 5. Two O-rings 6 and 7 as seal members are disposed at the joint portion of each constituent member 2, 3 and 4. A crank chamber 8 is encompassed and defined by the front housing 2 and the cylinder block 3. The front housing 2, the cylinder block 3 and the rear housing 4 constitute each constituent member that constitutes the main housing.

A rotary shaft 9 is inserted into a bore of a fitting member 10, penetrates through the crank chamber 8 and is extended and supported between the front housing 2 and the cylinder block 3. The rotary shaft 9 is allowed to rotate through a pair of radial bearings 11 and 12. Two O-rings 6 and 7 as the seal member are disposed at the joint portion between the inner peripheral surface of the front housing 2 and the fitting member 10. The front edge portion of the rotary shaft 9 is interconnected to an external driving source, not shown in the drawings.

A rotation supporter 13 is fixed to the rotary shaft 9 inside the crank chamber 8 and is allowed to rotate together with the rotary shaft 9 through a thrust bearing 14. A swash plate 15 is so supported as to be capable sliding in an axial direction of the rotary shaft 9 and is also capable of tilting. A hinge mechanism 16 is arranged between the rotation supporter 13 and the swash plate 15. The swash plate 15 is capable of tilting to the rotary shaft 9 and capable of rotating integrally with the rotary shaft 9. When the center portion of the swash plate 15 moves towards the cylinder block 3 along the rotary shaft 9, the tilting angle of the swash plate 15 decreases and when it moves towards the rotation supporter 13, on the contrary, the tilting angle of the swash plate 15 increases.

A cylinder bore 17 is so formed as to penetrate through the cylinder block 3. A single-head type piston 18 is accommodated in the cylinder bore 17 at one of its end portions, and the other end portion thereof is interconnected to the outer peripheral portion of the swash plate 15 through a shoe 19. The piston 18 is allowed to reciprocate back and forth inside the cylinder bore 17 by the rotation of the swash plate 15.

A suction chamber 20 and a discharge chamber 21 are partitioned and defined inside the rear housing 4. A suction valve 22, a suction port 23, a discharge valve 24 and a discharge port 25 are formed in a valve-port formation body 5. The refrigerant gas of the suction chamber 20 is sucked into the cylinder bore 17 by the reciprocation of the piston 18 through the suction valve 22 and the suction port 23. The refrigerant gas sucked into the cylinder bore 17 is compressed to a predetermined pressure by the reciprocation of the piston 18, and is discharged into the discharge chamber 21 through the discharge valve 24 and the discharge port 25.

A pressure releasing passage 26 has a throttle function inside the passage, and communicates the crank chamber 8 with the suction chamber 20. The refrigerant inside the crank chamber 8 is caused to flow out to the suction chamber 20 through the pressure releasing passage 26. The discharge chamber 21 is communicated with the crank chamber 8 by a solenoid control valve 27. The solenoid control valve 27 controls the refrigerant feed quantity from the discharge chamber 21 into the crank chamber 8. The pressure inside the crank chamber 8 is regulated depending on the refrigerant outflow quantity that flows out from the crank chamber 8 into the suction chamber 20 through the pressure releasing passage 26 having the throttle function, and depending on the refrigerant inflow quantity that flows from the discharge chamber 21 into the crank chamber 8 through the solenoid control valve 27. As a result, the tilting angle of the swash plate 15 is changed and the stroke of the piston 18 is changed, too, adjusting thereby the discharge capacity.

Figure 2:
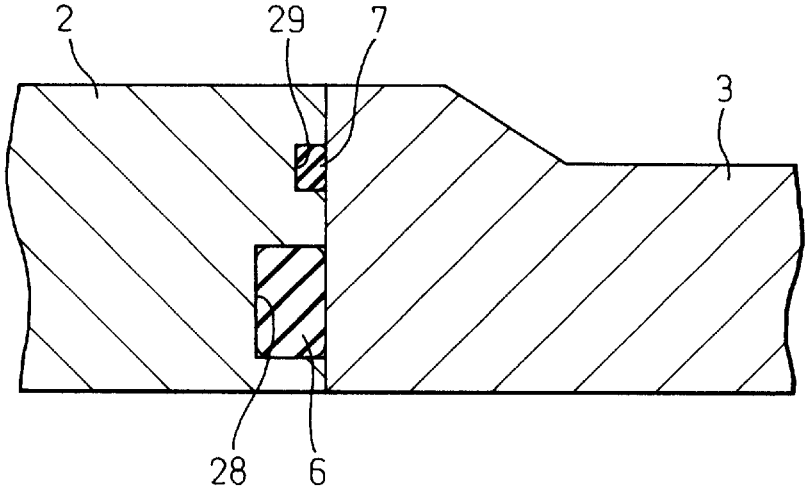
FIG. 2 is a partial sectional side view of a joint portion between a front housing and a cylinder block of the compressor according to the present invention.

As shown in FIGS. 1 and 2, two O-rings 6 and 7 are interposed at the joint portions between the front housing 2 and the cylinder block 3 and between the cylinder block 3 and the rear housing 4. The O-ring 6 is accommodated in inner seal grooves 28 formed in the front housing 2 and in the rear housing 4. The O-ring 7 is accommodated in outer seal grooves 29 formed in the front housing 2 and in the rear housing 4.

The inner O-ring 6 has a greater diameter than the outer O-ring 7. The inner O-ring 6 is made of a material having both excellent mechanical and chemical properties, that is, a nitrile rubber. The outer O-ring 7 is made of a material having high gas permeation resistance, that is, a butyl rubber. Here, the term "mechanical properties" means the heat-resistance and the blister resistance, and the term "chemical properties" means the oil resistance. The term "gas permeation resistance" means the degree of difficulty of gas leakage.

Figure 3:
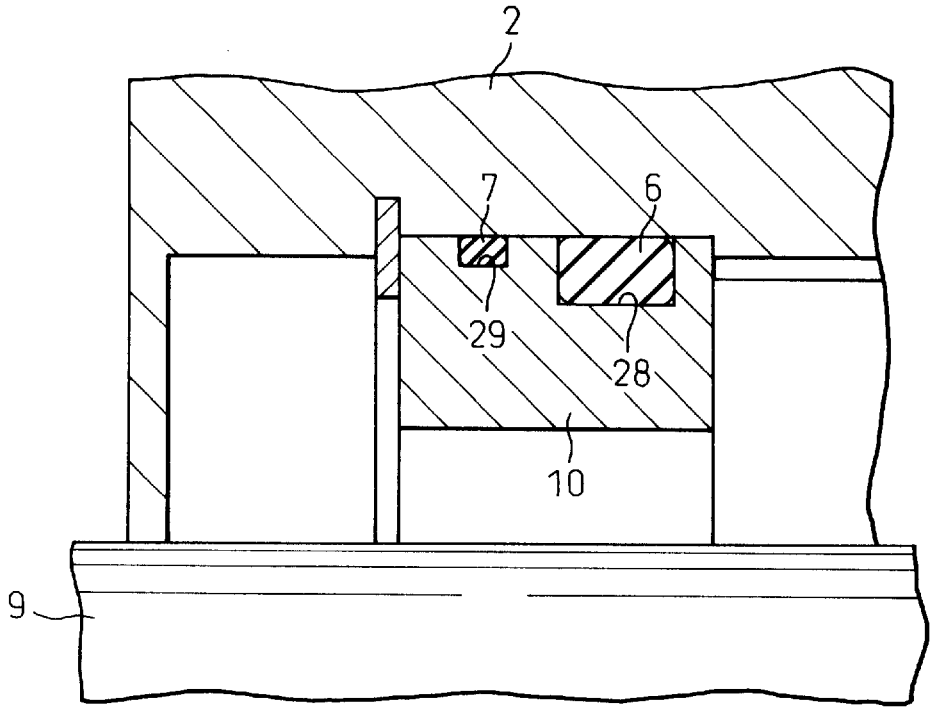
FIG. 3 is a partial sectional side view of a joint portion between a fitting member and the front housing of the compressor according to the present invention.

As shown in FIG. 3, the two O-rings 6 and 7 are also disposed at the joint portion between the inner peripheral surface of the front housing 2 and the fitting member (mechanical shaft seal) 10. These O-rings 6 and 7 are accommodated in the seal grooves 28 and 29 formed in the fitting member 10. The inner O-ring 6 (on the right side in FIG. 3) has a greater diameter than the outer O-ring 7 (on the left side in FIG. 3). The inner O-ring 6 uses a nitrile rubber that is excellent in both mechanical and chemical properties, and the outer O-ring 7 uses a butyl rubber that is excellent in the gas permeation resistance.

Sealing performance in the crank chamber 8 and in the suction chamber 20 can be improved by the two O-rings 6 and 7 that share the functions. In other words, the O-ring 6 having a greater diameter and disposed inside executes a main seal function, and plays the role of the heat resistance, the oil resistance and the blister resistance to the lubricant and to the refrigerant gas. Since O-ring 6 has a greater diameter, the sealing performance in the crank chamber 8 and in the suction chamber 20 can be further improved, and can sufficiently cope with a permanent compression strain, too. The outer O-ring 7 effects sealing after the main seal. Therefore, a ring having a smaller diameter is used. The O-ring 7 mainly plays the role of the gas permeation resistance to the refrigerant gas. Since the outer O-ring 7 has a smaller diameter, the thickness of both housings for disposing the two O-rings 6 and 7 becomes relatively small.

Therefore, this embodiment provides the following effects.

(1) Two O-rings 6 and 7 are disposed at each joint portion. The O-ring 6 made of the nitrile rubber having excellent mechanical and chemical properties is disposed inside, and the O-ring 7 made of the butyl rubber having the high gas permeation resistance is disposed outside. Since a plurality of O-rings 6 and 7 are disposed dividedly from the aspect of their functions, the materials having high performance can be employed for the respective O-rings. In consequence, even when carbon dioxide is used as the refrigerant, high sealability can be secured for the compressor 1. In comparison with the case where O-rings each made of a specific material excellent for each function is employed so as to improve sealability, selection of the materials becomes easier in this embodiment, and the material cost can be reduced.

(2) The diameter of the O-ring 6 disposed inside the joint portion is increased so that the O-ring 6 executes the main seal function. The O-ring 7 disposed outside uses the material having high gas permeation resistance, and its diameter is decreased. Since the inner O-ring 6 having a greater diameter executes the main seal function, the outer O-ring 7 needs to have excellent performance in only the gas permeation resistance. Therefore, even when the diameter of the O-ring 7 is decreased, this O-ring 7 can seal the refrigerant gas. For this reason, the thickness of the joint portion necessary for securing the arrangement space of the O-rings can be made smaller than when a plurality of O-rings having a relatively large diameter are disposed so as to secure sealing performance. Even when a limited amount of carbon dioxide is to permeate through the O-ring 7 made of the butyl rubber, the gas transmission passage is thinly reduced because the diameter of the O-ring 7 is small. Hence, the gas leak suppression effect can be obtained, too.

(3) When the seal structure of this embodiment is employed, a required sealing performance of the joint portion can be secured even when the high pressure gas having relatively high gas permeability to the rubber materials, such as carbon dioxide, is used as the refrigerant.

(4) The butyl rubber has low oil resistance. However, because the O-ring 6 made of the nitride rubber is disposed inside and the O-ring 7 made of the butyl rubber is disposed outside, degradation of the O-ring 7 made of the butyl rubber can be prevented. In other words, the butyl rubber can be used as the material of the O-ring. Since the butyl rubber has relatively high gas permeation resistance, high seal performance can be obtained at the joint portions by using the O-ring made of the butyl rubber.

(5) Nitrile rubber is used generally, and butyl rubber, too, is a general-purpose rubber. Therefore, the material cost of the seal structure using these two Orings 6 and 7 is low.

The embodiment is not particularly limited to the construction described above, but can be modified in the following way.

As to the materials of the O-rings 6 and 7, the material of the inner O-ring 6 is not particularly limited to those materials which are excellent in mechanical and chemical properties, and the material of the outer O-ring 7 is not particularly limited to those materials which are excellent in gas permeation resistance. In other words, though the inner O-ring has a greater diameter and the outer O-ring has a smaller diameter, the outer O-ring need not be excellent in the gas permeation resistance. For example, both O-ring 6 and 7 may be made of the nitrile rubber in the embodiment described above. In this case, since the outer O-ring has a smaller diameter, the permeation passage of the refrigerant gas passing through the outer O-ring is thinly reduced even when it is not excellent in the gas permeation resistance. Consequently, sealability can be improved much more than when the conventional O-rings having the same diameter are disposed double, and the thickness of the housing at the seal portion can be reduced.

Figure 4:
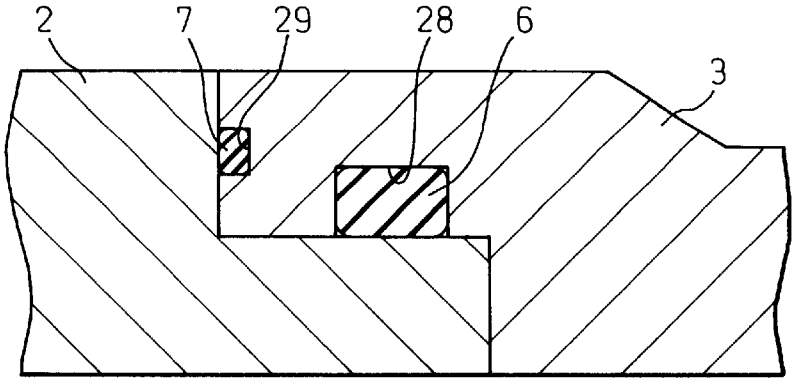
FIG. 4 is a partial sectional side view of a joint portion in another embodiment of the present invention.

The seal structure is not particularly limited to the structure of this embodiment, but may be the seal structure such as the one shown in FIG. 4. In this case, the joint portion between the front housing 2 and the cylinder block 3 has a shape of a fitting structure, and the seal grooves 28 and 29 for accommodating the O-rings 6 and 7 are formed at predetermined positions on the cylinder block side 3 as shown in FIG. 4. The O-ring 6 having a greater diameter is disposed inside and the O-ring 7 having a smaller diameter is disposed outside. According to this structure, the front housing 2 and the cylinder block 3 can be assembled more easily. This seal structure may be applied to the joint surface between the cylinder block 3 and the rear housing 4.

Figure 5:
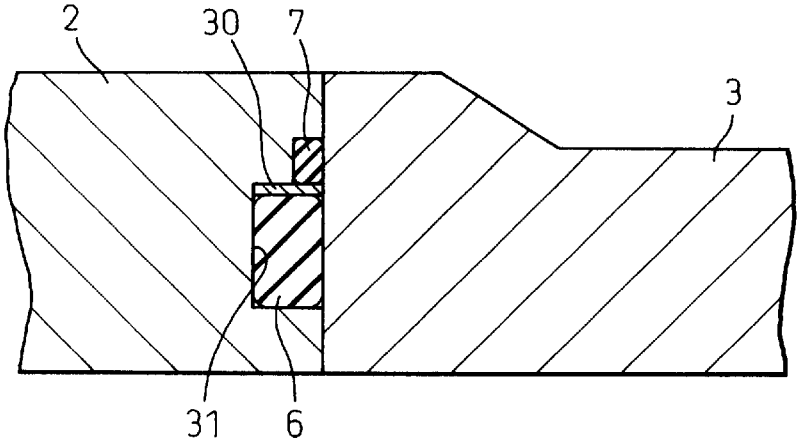
FIG. 5 is a partial sectional side view of a joint portion in still another embodiment of the present invention.

The seal structure at each joint portion may be one in which a back-up ring 30 is interposed between the two O-rings 6 and 7 as shown in FIG. 5. In this case, the two O-rings 6 and 7 are accommodated inside one seal groove 31, and the seal groove 31 is divided into two parts by the back-up ring 30. The depth of the seal groove 31 is divided into two depths in order to accommodate the O-rings 6 and 7 having mutually different diameters. This structure reduces the width at the seal portion in the thick-wise direction, and the thickness of the housing may be relatively smaller.

Figure 6:
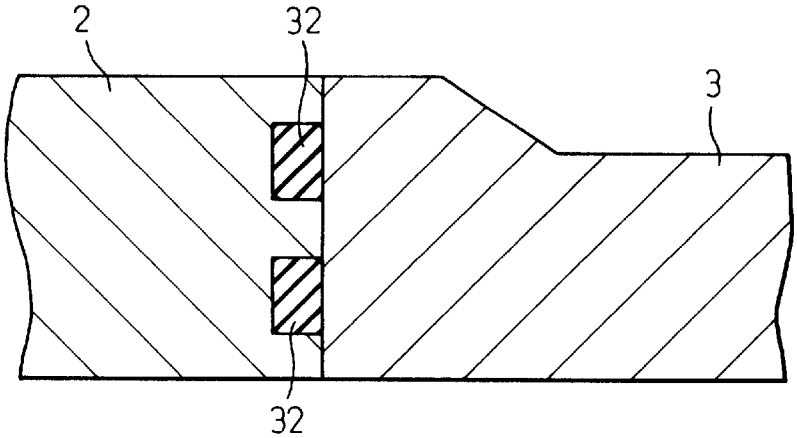
FIG. 6 is a partial sectional side view of a joint portion in still another embodiment of the present invention.

As shown in FIG. 6, the seal structure at each joint portion may be such that the O-rings 32 having the same diameter are used, and the material excellent in the mechanical and chemical properties is used for the inner O-ring 32 while the material excellent in the gas permeation resistance is used for the outer O-ring 32. According to this seal structure, the depth of the seal groove may be the same, and fabrication efficiency of the seal groove can be improved.

The O-rings 6 and 7 need not be limited to a double structure, and three or more O-rings having the same diameter may be disposed, for example. In this case, the O-ring excellent in mechanical and chemical properties is disposed inside, and the O-ring excellent in the gas permeation resistance is disposed outside. In the embodiment described above, for example, it is possible to dispose two O-rings 7 excellent in the gas permeation resistance outside the O-ring 6 having a greater diameter in the triple arrangement. The numbers of the O-ring 6 having a greater diameter and the O-ring 7 having a smaller diameter may be increased arbitrarily. In this way, sealing performance can be improved. If the materials of a plurality of O-rings are so selected as to share the respective functions, their diameters can be combined in desired ways. For example, the outer O-ring 7 may have a greater diameter. When three or more O-rings are disposed, the materials of each O-ring may be two or more kinds.

Each of the seal grooves 28 and 29 defined at the joint portions between both housings 2, 4 and the cylinder block 3 may be formed in either the front housing 2 or the rear housing 4 or in the cylinder block 3.

The refrigerant is not limited to carbon dioxide. For example, it may be freon or ammonia. Freon and ammonia are less able to permeate through the rubber material than carbon dioxide, and the sealing performance can be improved.

In the embodiment described above, the seal structure need not be necessarily disposed at all of the three joint portions. In other words, it may be provided to at least one of the three joint portions.

The material used for the O-ring 6 having a greater diameter is not limited to nitrile rubber. For example, it is possible to use another material which is excellent in mechanical and chemical properties, such as chloroprene rubber.

The material used for the O-ring 7 having a smaller diameter is not limited to butyl rubber. For example, it is possible to use another material which is excellent in the gas permeation resistance, such as a fluoro rubber.

The mechanical properties are not limited to heat resistance and blister resistance. The mechanical properties may include pressure resistance and wear resistance, for example.

The constituent members of the main housing are not limited to both housings 2 and 4 and the cylinder block 3. For example, the cylinder block 3 may comprise a pair of blocks.

The type of the compressor 1 used in this embodiment has been explained by a single-headed piston compressor, but the seal structure may be adapted to a double-headed piston compressor or to a scroll type compressor.

As described above in detail, the present invention disposes the seal members in accordance with their functions, and can therefore use materials having higher functions. Therefore, even when carbon dioxide which can easily permeate a rubber material is used as the refrigerant, the present invention can secure high seal performance of the joint portions.

In the present invention, even if the gas leaks as it permeates through the seal member having a greater diameter, for example, the gas is checked by the outer seal member. Moreover, because the seal member having a smaller diameter reduces thinly the gas permeation passage, sealing performance can be improved. Because the outer seal member has a smaller diameter, the thickness of the joint portion, at which the seal member is disposed, can be reduced.

Even when the refrigerant is carbon dioxide, seal performance against this gas can be improved in comparison with the prior art compressors.

Although the invention has thus been described in its preferred form, it is to be understood that various modifications could be made by those skilled in the art without departing from the basic concept and scope of the invention.

What is claimed is:

1. A seal structure of a compressor including seal members interposed into joint portions between constituent members of a main housing and into joint portions between fitting members fitted into a bore for inserting a rotary shaft and said housing, characterized in that a plurality of said seal members are provided to at least one of said joint portions, a seal member excellent in both mechanical and chemical properties is disposed inside, among a plurality of said seal members, and a seal member excellent in gas permeation resistance is disposed outside, among a plurality of said seal members.

2. A seal structure of a compressor according to claim 1, wherein said constituent members comprise a cylinder main body, a front housing and a rear housing, and a plurality of said seal members are provided to the joint portions between said cylinder main body and both of said housings.

3. A seal structure of a compressor according to claim 1, wherein a plurality of said seal members are provided to the joint portion between said fitting member and the inner peripheral surface of said housing.

4. A seal structure of a compressor according to claim 1, wherein a refrigerant used for said compressor is carbon dioxide.

5. A compressor equipped with said seal structure according to claim 1.

6. A seal structure of a compressor including seal members interposed into joint portions between constituent members of a main housing and into joint portions between fitting members fitted into a bore for inserting a rotary shaft and said housing, characterized in that a plurality of said seal members having mutually different diameters are provided to at least one of said joint portions, said seal member having a greater diameter among a plurality of said seal members is disposed inside and said seal member having a smaller diameter is disposed outside.

7. A seal structure of a compressor according to claim 6, wherein said seal member having a greater diameter uses a material excellent in mechanical and chemical properties, and said seal member having a smaller diameter uses a material excellent in gas permeability resistance.

8. A seal structure of a compressor according to claim 6, wherein said constituent members comprise a cylinder main body, a front housing and a rear housing, and a plurality of said seal members are provided to the joint portions between said cylinder main body and both of said housings.

9. A seal structure of a compressor according to claim 6, wherein a plurality of said seal members are provided to the joint portions between said fitting member and the inner peripheral surface of said housing.

10. A seal structure of a compressor according to claim 6, wherein the refrigerant used for said compressor is carbon dioxide.

11. A compressor equipped with said seal structure according to claim 6.

* * * * *